US010602834B2

(12) United States Patent
Holland

(10) Patent No.: US 10,602,834 B2
(45) Date of Patent: Mar. 31, 2020

(54) NOSE BRUSH

(71) Applicant: Dane Holland, Sugar Hill, GA (US)

(72) Inventor: Dane Holland, Sugar Hill, GA (US)

( * ) Notice: Subject to any disclaimer, the term of this patent is extended or adjusted under 35 U.S.C. 154(b) by 525 days.

(21) Appl. No.: 15/051,393

(22) Filed: Feb. 23, 2016

(65) Prior Publication Data

US 2017/0238685 A1 Aug. 24, 2017

(51) Int. Cl.
*A46B 5/00* (2006.01)
*A46B 9/02* (2006.01)

(52) U.S. Cl.
CPC ..... *A46B 5/0016* (2013.01); *A46B 9/02* (2013.01); *A46B 2200/01* (2013.01); *A46B 2200/1006* (2013.01)

(58) Field of Classification Search
CPC ..... A61F 13/126; A61F 11/006; A61F 13/38; A61B 2017/246; A61B 2017/320012; B08B 1/001; A46B 5/0016; A46B 9/00; A46B 2200/10; A46B 2200/1006; A46B 9/005; A46B 9/02; A46B 9/026; A46B 9/028; A61M 2210/0618
USPC ..... 15/106, 114, 118, 160, 210.1; 132/218, 132/320, 321
See application file for complete search history.

(56) References Cited

U.S. PATENT DOCUMENTS 4,767,398 A * 8/1988 Blasius, Jr. ..... A45D 40/28 604/1
5,044,383 A * 9/1991 Alessio ..... A45D 29/16 132/320
5,738,643 A * 4/1998 Stredic, III ..... A61F 13/38 15/210.1
8,551,031 B2 * 10/2013 Edme ..... A61F 13/38 604/1

* cited by examiner

*Primary Examiner* — Monica S Carter
*Assistant Examiner* — Abbie E Quann
(74) *Attorney, Agent, or Firm* — Incorporating Innovation LLC; Charlena Thorpe, Esq.

(57) ABSTRACT

Implementations of a nose brush are provided. In some implementations, the nose brush comprises an elongated handle having a first end and a second end. The nose brush further comprises a brush head affixed to at least one of the ends of the handle. In some implementations, the brush head comprises a body and fibers extending from the body where the body is tapered such that the width of the brush head at a distal end is smaller than the width of the brush head at a proximal end. In some implementations, the fibers are elongated and are distributed around the brush head and on the top of the brush head. In some implementations, the body comprises an absorbent fibrous material. In some implementations, the handle and brush head are biodegradable and disposable.

15 Claims, 1 Drawing Sheet

NOSE BRUSH

TECHNICAL FIELD

This disclosure relates to implementations of a nose brush.

BACKGROUND

U.S. Pat. No. 8,241,236 discloses an apparatus 100 for cleaning a nasal cavity comprising a grip portion and a cleaning portion. The '236 patent discloses that the cleaning portion includes a head and a nasal cleaning cloth. The '236 patent further discloses that the cloth may have a weaved and/or mesh type pattern.

U.S. Patent Appl. Pub. No. 2011/0054377 discloses a nose cleaning device generally in the form of a pair of tweezers where each tweezer arm has a cotton bud at the end. The '377 patent application also discloses that the connected ends of the tweezer arms share a further bud that can be used as a normal cotton bud. The '377 patent application further discloses that buds can be made from cotton or other cellulose-based material, although synthetic materials can also be used. The fibers used may be absorbent and/or the open spaces used between fibers within the structure can be used as the mechanism for absorbing and cleaning.

PCT Patent Appl. International Pub. No. WO 2002/053076 discloses a nose cleaning device made of an absorbing and atraumatic material, which according to the '076 application, is material that is relatively soft and can be easily deformed such as cellulose fibres or pulp.

None of the above references disclose a nose cleaning apparatus having a brush design.

CN 2276336 discloses a nostril brush with brush hair. However, the nostril brush disclosed in the '336 patent has a relatively complex design.

CN 201356785 also discloses a nostril cleaner with a hair brush. However, the nostril brush disclosed in the '336 patent also has a relatively complex design and is not disposable and biodegradable.

DETAILED DESCRIPTION

Implementations of a nose brush are provided. In some implementations, the nose brush may be designed to clean a nostril area (as opposed to the nasal cavity). In some implementations, the nose brush comprises an elongated handle having a first end and a second end. The nose brush further comprises a brush head affixed to at least one of the ends of the handle. In some implementations, the brush head comprises a body and fibers extending from the body where the body is tapered such that the width of the brush head at a distal end is smaller than the width of the brush head at a proximal end. In some implementations, the fibers are elongated and are distributed around the brush head and on the top of the brush head. In some implementations, the body comprises an absorbent fibrous material. In some implementations, the handle and brush head are biodegradable and disposable.

Figure 1:
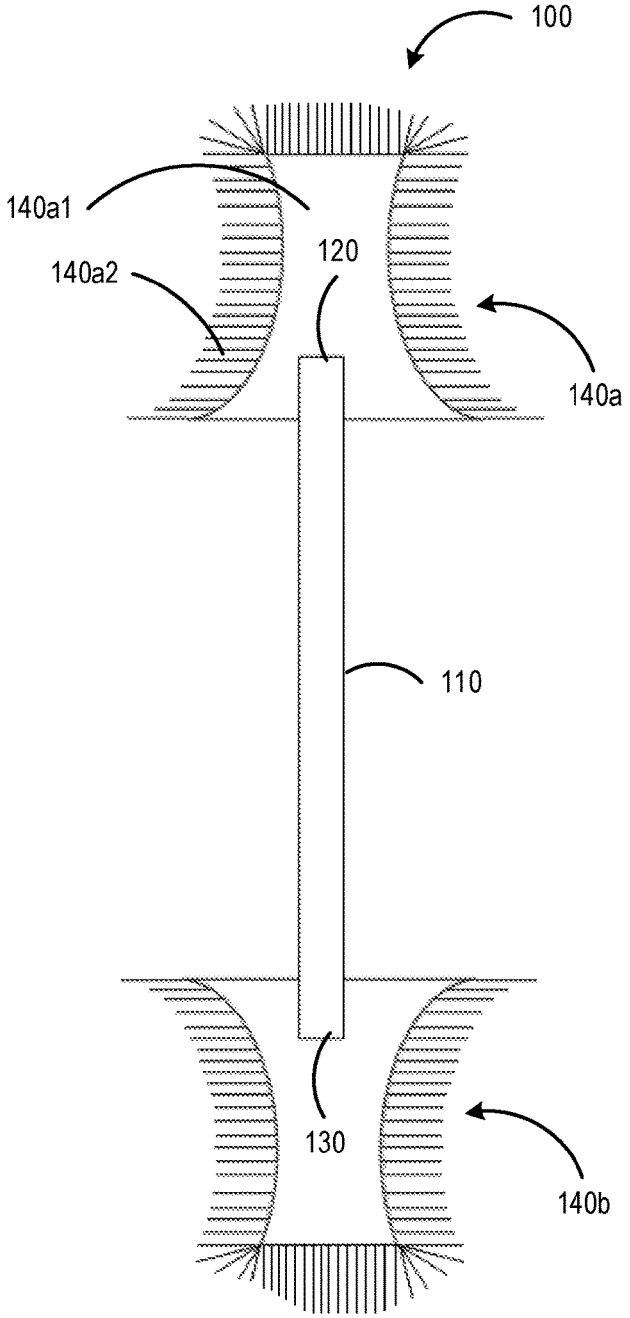
FIG. 1 illustrates an example cross-sectional view of a nose brush according to an implementation of the present disclosure.

FIG. 1 illustrates an example cross-sectional view of a nose brush 100 according to an implementation of the present disclosure. In some implementations, the nose brush 100 comprises an elongated handle 110 having a first end 120 and a second end 130 and a nose brush head affixed to at least one of the ends of the handle 110.

As shown in FIG. 1, in some implementations, a first brush head 140*a* may be affixed to the first end 120 of the handle 110 and a second brush head 140*b* may be affixed to the second end 130 of the handle 110.

In some implementations, the first brush head 140*a* and the second group of brush head 140*b* may have the same shape or substantially the same shape where any differences may be attributable to manufacturing. In some implementations, the first brush head and the second brush head may have a different shape.

Figure 2:
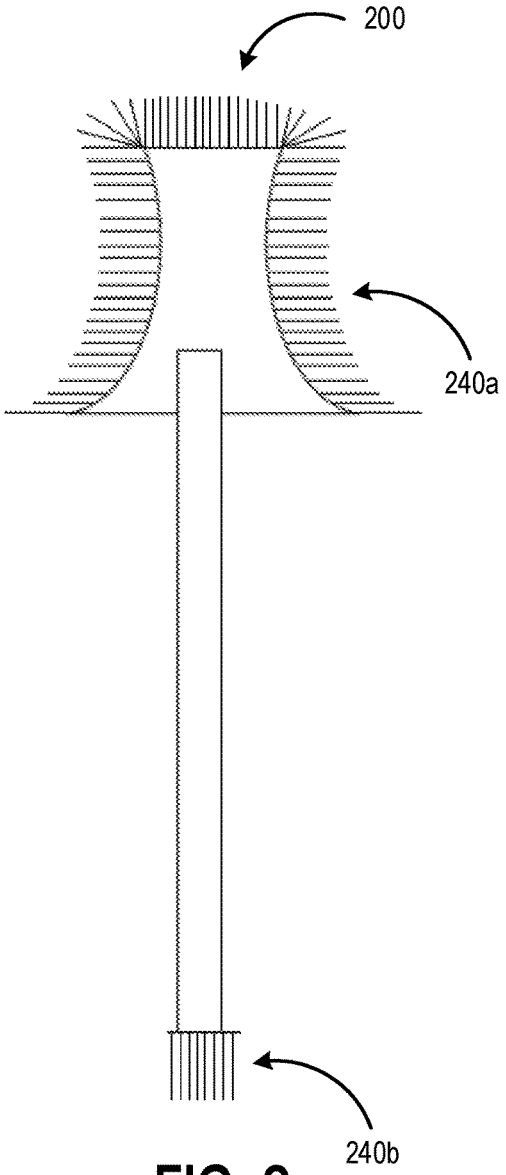
FIG. 2 illustrates another example cross-sectional view of a nose brush according to an implementation of the present disclosure.

FIG. 2 illustrates another example nose brush 200 according to an implementation of the present disclosure. The example nose brush 200 is similar to the nose brush 100 except that the first brush head 240*a* and the second brush head 240*b* have different shapes.

In some implementations, only one brush head may be affixed to one of the ends of the handle 110.

In some implementations, a brush head may comprise a group of fibers (e.g., 140*a*1) (e.g., cotton) and bristles (e.g., 140*a*2) that extend from the group of fibers. In some implementations, the group of fibers may be an absorbent fibrous material. In some implementations, the brush head may be made from a biodegradable material. In some implementations, the brush head may be made from a non-biodegradable material. In some implementations, a brush head may comprise any suitable or desirable material.

In some implementations, the bristles may be elongated fibers (e.g., cotton). In some implementations, the bristles may be stiff.

In some implementations, the bristles may extend radially from the brush head. In some implementations, the bristles may be distributed around the brush head. In some implementations, no bristles may extend from the bottom of the brush head. In some implementations, bristles may extend from the bottom of the brush head. In some implementations, the bristles are distributed uniformly around the brush head. In some implementations, the bristles may be arranged in a plurality of elongated columns extending lengthwise around the brush head. In some implementations, the bristles are arranged in three columns extending lengthwise and equally distributed around the brush head. In some implementations, the bristles are arranged in four columns extending lengthwise and equally distributed around the brush head. In some implementations, the bristles are arranged in eight columns extending lengthwise and equally distributed around the brush head. In some implementations, the bristles are distributed non-uniformly around the brush head.

In some implementations, as shown in FIG. 2, the bristles 240*b* extend from the handle 110.

In some implementations, the bristles are configured (e.g., in length, thickness, material, density, etc.) to brush nostril hairs and/or collect dislodged nose debris.

In some implementations, the bristles may be made from cotton. In some implementations, the bristles may be made from a biodegradable material. In some implementations, the bristles may be made from a non-biodegradable material. In some implementations, the bristles may be made from any suitable or desirable material.

In some implementations, the brush heads or group or fibers (e.g., 140*a*, 140*b*, 240*a*) may have a tapered design where the width of a brush head at a distal end (i.e., the end farthest from the handle 110) is smaller than the width of the brush head at a proximal end (i.e., the end closest to the handle 110).

In some implementations, the width of a brush head excluding the bristles at a distal end may be ¼ inches or thereabout and the width of the brush head excluding the bristles at a proximal end may be ⅝ inches or thereabout. In some implementations, the length of the bristles extending from a brush head may be ⅛ inches or thereabout. Thus, in some implementations, the total width of brush head at a distal end may be ½ inches or thereabout and the total width of the brush head at a proximal end may be ⅞ inches or thereabout.

In some implementations, the length of the bristles extending from the brush head at the top of the brush head may be longer than the bristles extending from the remainder of the brush head. This may help to prevent a user from projecting a brush head too far into the nasal cavity of a user.

Figure 3:
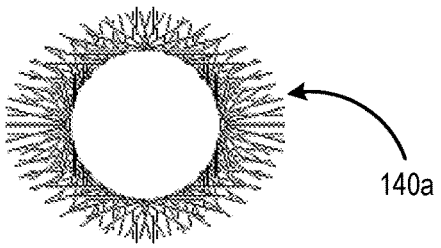
FIG. 3 illustrates a top view of a cross-section of the brush head of FIG. 1.

In some implementations, the brush head may be any suitable or desirable shape. In some implementations, the brush head may have a rounded top end. In some implementations, the brush head may be circular as shown in FIG. 3 of a top view of a cross-section of the brush head 140*a*.

In some implementations, the length of the exposed handle may be greater than or equal to the combined length of both brush heads affixed to the ends of the handle. In some implementations, the length of the handle 110 may be less than the combined length of both brush heads affixed to the ends of the handle. In some implementations, the length of the exposed handle may be between 1" and 1.5". In some implementations, the length of the exposed handle may be less than 1". In some implementations, the length of the exposed handle may be greater than 1.5". In some implementations, the length of the exposed handle may be 2" or thereabout. In some implementations, the length of the exposed handle may be any suitable size.

In some implementations, the handle 110 may be made from wood, paper, or any other biodegradable material. In some implementations, the handle 110 may be made from a non-biodegradable material. In some implementations, the handle 110 may be made from plastic, natural rubber, synthetic rubber, or any other desirable material. In some implementations, the handle 110 may include grooves or a roughened surface for gripping the handle.

Reference throughout this specification to "an embodiment" or "implementation" or words of similar import means that a particular described feature, structure, or characteristic is included in at least one embodiment of the present invention. Thus, the phrase "in some implementations" or a phrase of similar import in various places throughout this specification does not necessarily refer to the same embodiment.

Many modifications and other embodiments of the inventions set forth herein will come to mind to one skilled in the art to which these inventions pertain having the benefit of the teachings presented in the foregoing descriptions and the associated drawings.

The described features, structures, or characteristics may be combined in any suitable manner in one or more embodiments. In the above description, numerous specific details are provided for a thorough understanding of embodiments of the invention. One skilled in the relevant art will recognize, however, that embodiments of the invention can be practiced without one or more of the specific details, or with other methods, components, materials, etc. In other instances, well-known structures, materials, or operations may not be shown or described in detail.

While operations are depicted in the drawings in a particular order, this should not be understood as requiring that such operations be performed in the particular order shown or in sequential order, or that all illustrated operations be performed, to achieve desirable results.

The invention claimed is:

1. A nose brush comprising:

an elongated handle having a first end and a second end; and a first brush head affixed to at least one of the first or second ends of the handle wherein the first brush head comprises a body and fibers extending from the body wherein the body has a proximal end and a distal end wherein the proximal end is affixed to the handle and wherein each said fiber has a first end and a second end wherein the first end of the fiber is attached to the body and the fiber extends radially away from the body such that the fiber does not lie flat on the body, wherein the body width decreases then increases from the distal to the proximal end such that the width of the first brush head at an outermost surface of the distal end farthest from the handle is smaller than the width of the first brush head at an outermost surface of the proximal end closest to the handle; and the fibers are elongated and distributed around the body and further include fibers on a top of the body at the distal end.

2. The nose brush of claim 1 wherein the body comprises an absorbent fibrous material.

3. The nose brush of claim 1 wherein the handle and the body and fibers are biodegradable.

4. The nose brush of claim 3 wherein the handle and first brush head are disposable.

5. The nose brush of claim 1 comprising the first brush head affixed to the first end of the handle and a second brush head affixed to the second end of the handle.

6. The nose brush of claim 5 wherein the first brush head and the second brush head have substantially the same shape.

7. The nose brush of claim 5 wherein the first brush head and the second brush head have different shapes.

8. The nose brush of claim 7 wherein the first brush head comprises the body and the fibers extending from the body, wherein the body is tapered such that the width of the first brush head at the distal end is smaller than the width of the first brush head at the proximal end; and wherein the second brush head comprises elongated fibers extending directly from the second end of the handle.

9. The nose brush of claim 1 wherein the elongated fibers on the top of the body are longer than the elongated fibers distributed around the body.

10. The nose brush of claim 2 wherein the elongated fibers extending from the body are configured to collect dislodged nose debris.

11. The nose brush of claim 1 wherein the elongated fibers extending from the body are made from cotton.

12. The nose brush of claim 1 wherein the width of the body of the first brush head at the distal end is substantially ¼ inches and the width of the body of the first brush head at the proximal end is substantially ⅝ inches.

13. The nose brush of claim 12 wherein for each of said elongated fibers extending from the body, the second end is substantially ⅛ inches away from the body.

14. The nose brush of claim 13 wherein length of the exposed handle is substantially two inches.

15. The nose brush of claim 5 wherein length of the handle is greater than or equal to the combined length of the first and second brush heads affixed to the first and second ends of the handle.

* * * * *